United States Patent [19]

Duerksen

[11] Patent Number: 4,488,598

[45] Date of Patent: Dec. 18, 1984

[54] STEAM, NONCONDENSABLE GAS AND FOAM FOR STEAM AND DISTILLATION DRIVE IN SUBSURFACE PETROLEUM PRODUCTION

[75] Inventor: John H. Duerksen, Fullerton, Calif.

[73] Assignee: Chevron Research Company, San Francisco, Calif.

[21] Appl. No.: 476,642

[22] Filed: Mar. 18, 1983

[51] Int. Cl.[3] ..... E21B 43/24; E21B 47/06

[52] U.S. Cl. ..... 166/252; 166/266; 166/272

[58] Field of Search ..... 166/252, 263, 272–274, 166/266, 303

[56] References Cited

U.S. PATENT DOCUMENTS

| | | | |
|---|---|---|---|
| 3,412,794 | 11/1968 | Craighead | 166/272 |
| 4,086,964 | 5/1978 | Dilgren et al. | 166/252 X |
| 4,099,568 | 7/1978 | Allen | 166/272 X |
| 4,161,217 | 7/1979 | Dilgren et al. | 166/252 |
| 4,324,291 | 4/1982 | Wong et al. | 166/252 |
| 4,393,937 | 7/1983 | Dilgren et al. | 166/272 |

*Primary Examiner*—George A. Suchfield

*Attorney, Agent, or Firm*—G. W. Wasson; L. S. Gruber; Edward J. Keeling

[57] ABSTRACT

A method is disclosed for increased recovery of crude petroleum from a subsurface formation containing petroleum deposits. The method combines steam and gas distillation drive using foam to divert the steam/gas and to establish a thermal barrier against heat loss into the surrounding formations. A noncondensable gas is injected with or after steam to produce a distillate bank which is moved through the formation from an injection well toward a production well. Fluids produced at the production well are monitored to provide information for control of the injected materials at the injection well.

3 Claims, 4 Drawing Figures

STEAM, NONCONDENSABLE GAS AND FOAM FOR STEAM AND DISTILLATION DRIVE IN SUBSURFACE PETROLEUM PRODUCTION

BACKGROUND OF THE INVENTION

This invention relates to a method of recovering crude petroleum from subsurface earth formations, and more particularly, to a method of recovering crude petroleum from the subsurface by a steam and gas distillation drive process. The method may be used in primary recovery processes in highly viscous petroleum deposits as well as in secondary recovery processes where lighter crudes have already been recovered.

It has been known that residual oil can be produced from reservoirs by a combination of steam displacement and steam distillation. In a steam distillation process, hydrocarbons are more readily vaporized because of a lowering of their partial pressures in the presence of steam vapor. The light components are distilled from the residual oil and transported to the steam front where they condense and mix with the residual oil to form a bank of distillate and residual oil. As the steam zone advances, this distillate bank is displaced and redistilled to further increase oil recovery. With a steam distillation process it is possible to produce oil from a formation and to leave residual oil saturations below those obtainable by steam driving nondistillable oils.

A steam distillation recovery process is expected to recover more residual oil than a waterflood process because the steam distillation process (1) reduces oil viscosity, which improves oil mobility; (2) thermally expands the oil; (3) establishes gas drive from the steam vapor phase; and (4) distills the lighter oil components.

It is known to pump steam into a vertical borehole to produce a steam flood laterally into the formation in order to heat the oil in the formation to render it less viscous and to produce a driving force from the steam to move the oil to other recovery wells. It has been found in steam flood operations that the drive provided by the steam will collapse when the temperatures in the formation fall below the boiling point of water. In order to avoid the loss of these recovery mechanisms, inert or noncondensable gases have been added to the steam in order to enhance and maintain an oil-driving force within the formation.

As noted above, various attempts have been made to recover oil in a reservoir surrounding a vertical well by employing a mixture of steam and an inert or noncondensable gas. For example, in U.S. Pat. No. 3,908,762, a complex steam injection process is described which employs a mixture of steam and a noncondensable gas. In that patent the improvement is primarily based upon the disclosure that the noncondensable gases may include nitrogen, air, $CO_2$, flue gas, exhaust gas, methane, natural gas, and ethane.

In U.S. Pat. No. 4,257,650, a process is described for horizontal well bores wherein a mixture of steam and noncondensable gas is injected into the formation from the horizontal well. The driving mechanism of the mixture in the formation may be selectively maintained or enhanced at the same time that the viscosity of the oil in the formation is being reduced due to the heat from the steam.

U.S. Pat. No. 4,086,964 describes the use of a foam-forming mixture of steam, noncondensable gas and surfactant injected into a steam channel in an oil reservoir in which stratification of the rock permeability is insufficient to confine steam within the permeable strata. The noncondensable gas added to the foam and steam is in very low concentration to stabilize the foam. The gas is included in fractions of a mole percent in the foam and the foam is intended to resist the flow of steam through the oil-depleted steam zone, thereby diverting the steam into undepleted zones.

These four representations of the prior art illustrate that it has been known to combine (a) heating of a reservoir with steam to increase the mobility of crude therein, (b) with the concept of heat distillation of the crude to develop a gas drive mechanism, (c) and the injection of a noncondensable gas with steam to further assist in the drive mechanism within the reservoir, (d) and the injection of foamable surfactant with steam and small amounts of noncondensable gas to improve the steam sweep efficiency.

SUMMARY OF THE INVENTION

The novelty of the process described herein lies in the effect that vapor volume and temperature have on distillation of the reservoir crude. The combination of injection of high temperature steam for the steam distillation of the reservoir crude to produce a distillate bank with the injection of noncondensable gas increases the vapor volume and further enhances distillation of the reservoir crude.

Several variations on the injection procedures are disclosed with the basic procedure comprising:

(a) initially inject high temperature, high-pressure steam at a high rate (but below fracture pressure for the reservoir) to maximize steam distillation around the injection well and to cause the rapid formation of a distillate bank close to the injection well;

(b) maintain the high-steam injection temperature, pressure and rate to maximize steam distillation effects, promote rapid oil recovery, and minimize the time for heat loss;

(c) after substantial heating of the reservoir and/or steam breakthrough at a nearby producing well, reduce or stop steam injection and initiate injection of a volume of noncondensable gas sufficient to scavenge heat from the heated reservoir and to maintain the distillation recovery mechanism.

(d) to overcome gravity override or channeling within the reservoir by the noncondensable gas or steam gas combination, a suitable foaming surfactant is injected with the gas to create a foam block in the swept zone and divert the gas or steam gas combination into unswept zones of the reservoir. Other diverting processes (polymers, emulsions, etc.) may also be used. The noncondensable gas may consist of, but not be limited to, one or more of the following gases: nitrogen, air, $CO_2$, flue gas, hydrocarbon gas (i.e., methane, ethane, propane, butane, pentane, and any hydrocarbons that are gaseous at steamflood conditions).

Further modifications of the foregoing process will be described hereinafter.

The object of the present invention is to improve the recovery of crude oil from a subsurface reservoir by the combination of processes of steam injection to accomplish formation heating and petroleum distillation with the injection of a noncondensable gas to further enhance the petroleum heating and distillation plus the introduction of a foam block to direct the heat distilled petroleum, noncondensable gas and steam to the unswept portions of the reservoir where recoverable crude petroleum is expected to reside.

Further objects and features of the present invention wil be readily apparent to those skilled in the art from the appended drawings and specification illustrating preferred embodiments wherein.

DETAILED DESCRIPTION OF THE INVENTION

Figure 1:
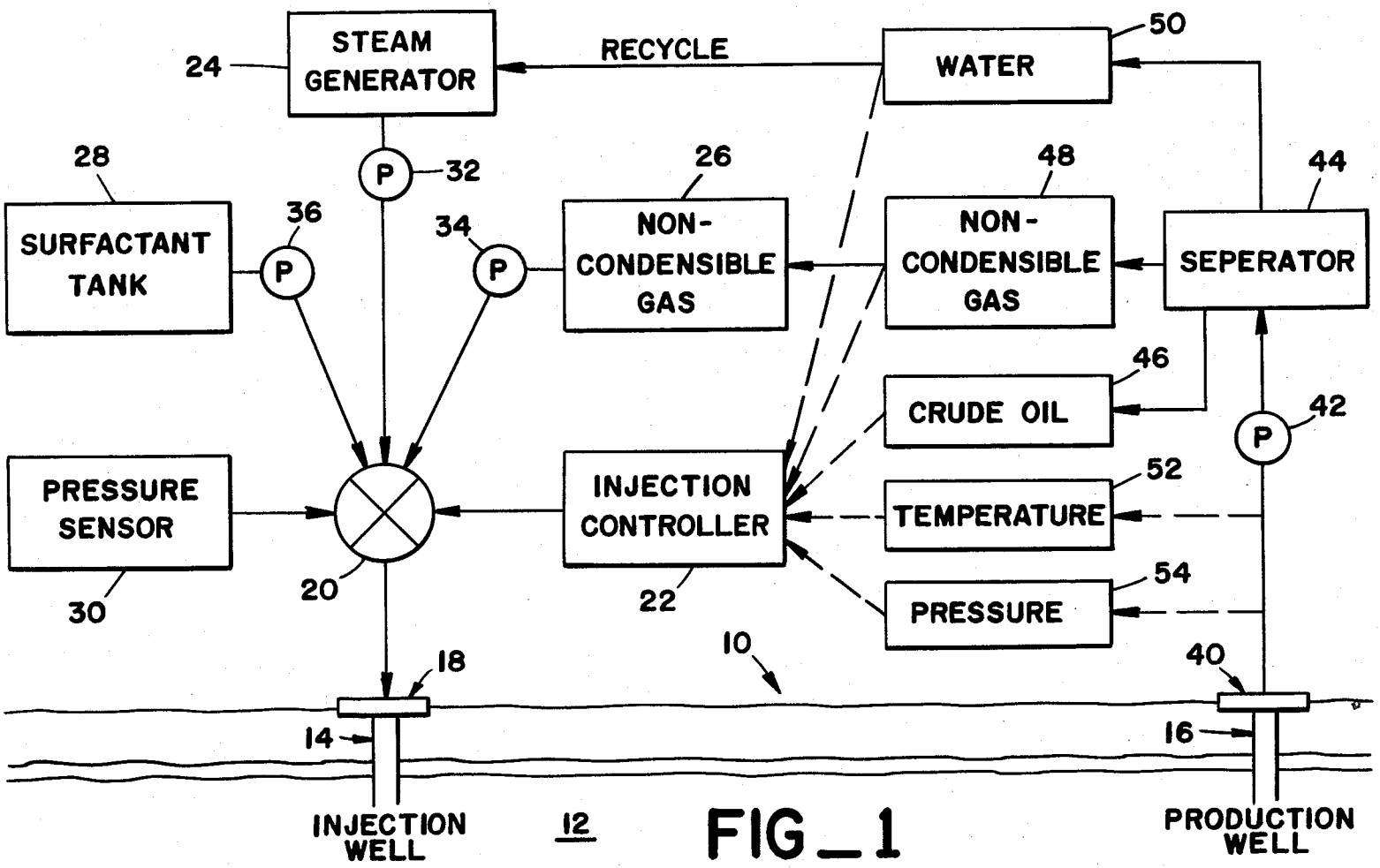
FIG. 1 is a block diagram of the injection and production elements useful in performing the method of the present invention.

In accord with the present invention, a plurality of materials are injected singly and in combinations into a subsurface petroleum-containing reservoir to cause the petroleum to move into a producer well. As illustrated in FIG. 1, the earth formation 10 has a subsurface petroleum-containing formation 12 with an injection well 14 and a producing well 16 passing through the formation to the reservoir. The wellhead 18 of the injection well 14 has a multipurpose valve 20 connected to it for control of materials injected into the formation through the injection well.

An injection controller 22 controls the manifold system 20 to control the injection of steam from steam generator 24, the injection of noncondensible gas from source 26, the injection of a foamable surfactant from tank 28, and the overall pressure within the wall is sensed through sensor 30 in accord with the rates of injection of the steam, gas and foam. Each of the separate sources of injection materials 24, 26 and 28 is supplied to the manifold 20 through separate pumps 32, 34 and 36.

The producing well 16 has a wellhead at 40 through which materials produced from the reservoir 12 are pumped with the assistance of pump 42, if needed. The produced materials are passed to a separator 44 where at least crude oil, noncondensable gas, and water are separated and supplied to suitable containers 46, 48 and 50, respectively. The water container 50 is shown connected to the steam generator 24 to permit recycling of the produced water after cleanup and the noncondensable gas container 48 is shown connected to the gas source 26 to permit recapture and recycling of the injected gas. It should be understood that the separator 44 is also capable of separating foam from the materials produced through production well 16 and the foam will collapse in the conventional manner or upon treatment with foam breaking chemicals.

Temperature sensor 52 and pressure sensor 54 are connected to the production line from the producing well 16 and are intended to represent sensing means for determining the conditions at the wellhead or within the reservoir, whichever is desired.

Each of the containers 46, 48 and 50 and the sensors 52 and 54 is connected in an operational sense to the injection controller 22 to permit the controller to be informed to the conditions in the container or sensor. As will be described hereinafter, the materials injected and the condition of the injected materials will be varied in accord with the method of the present invention in response to conditions sensed or occurring at the production well.

Figure 2A:
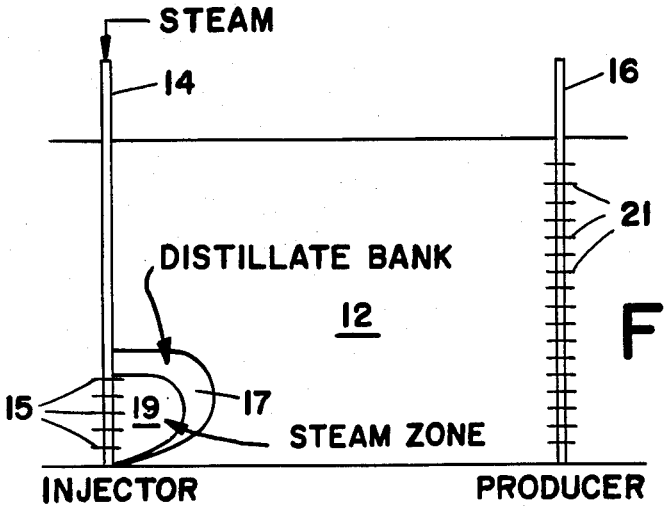
FIGS. 2A, 2B and 2C are cross-sectional views through a subsurface petroleum-containing reservoir illustrating in time sequence the method of the present invention.
Figure 2B:
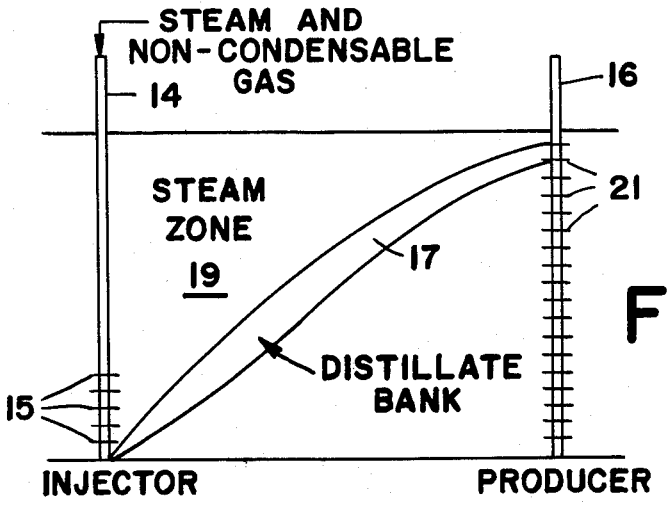
Figure 2C:
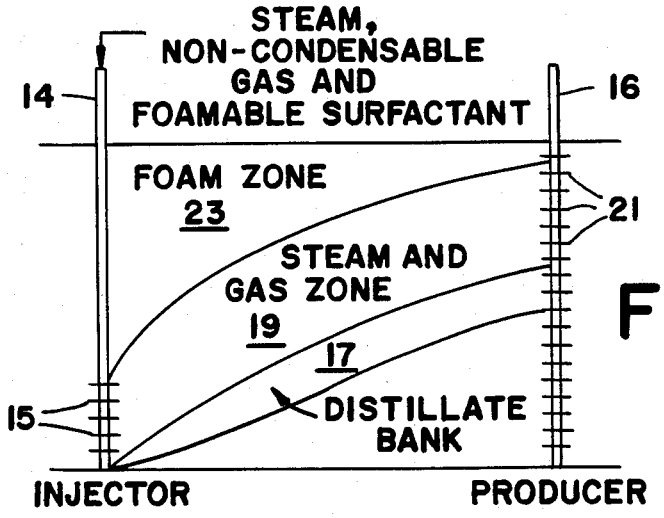

With the elements shown in FIG. 1 it is possible to control the separate, sequential or simultaneous injection of steam, noncondensable gas or foamable surfactant at desired pressure and temperature to accomplish the formation sweep illustratively shown in FIGS. 2A, 2B and 2C. It should be understood that these figures are illustrative of cross-sectional views through an earth formation and show conceptually the movement of injected materials through the formation from an injection well to a producing well.

As illustrated in FIG. 2A, steam is initially injected through injection well 14 penetrating an earth formation into a petroleum containing formation 12. The well 14 is perforated at 15 at the lower end of the injection well.

Steam injected through the perforations 15 heats and partially distills the petroleum within the formation and creates a distillate bank 17 ahead of the steam zone 19 and behind the unheated petroleum.

After prolonged injection of steam through the injection well, the steam and distillate bank eventually break through to the perforations 21 in production well 16 having pushed heated petroleum ahead of the steam. In accord with the procedures described herein, a combination of steam, noncondensible gas and foam maximize the recovery of petroleum from the formation by improving the sweep efficiency of the steam and the heating of the formation.

After the steam and distillate bank break through to the producing well, a combination of noncondensable gas, foamable surfactant and steam is injected through the injection well 14 to produce a foam zone 23 in the depleted portion of the steam zone above the oil-producing steam zone 19. The foam zone 23 inhibits the passage of steam directly into the producing well 16 and creates a flow resistance to force the steam and noncondensable gas to produce a continuing distillate bank 17 into the formation 12, thus encouraging an efficient sweep of the formation and production of the crude into the well 16.

The novelty of the processes described in this disclosure lies mainly in the effect that vapor volume and temperature have on distillation of the crude oil. The injection of high temperature steam enhances the distillation of the crude oil and the formation of a distillate bank. The injection of a noncondensable gas increases the vapor volume, which also enhances distillation of the crude oil. The injection of foam after or with the steam and noncondensable gas assists in the recovery by preventing loss of the steam and gas through depleted zones in the formation.

One procedure for the steam and gas distillation drive process of the present invention is the following steps:

Process 1

(a) Initially inject high temperature, high-pressure steam at a high rate (but below fracture pressure) to maximize steam distillation around the injection well and to cause the rapid formation of a distillate bank close to the injection well.

(b) Maintain the high steam injection temperature, pressure and rate to maximize steam distillation effects, promote rapid oil recovery, and minimize the time for heat loss.

(c) After substantial heating of the reservoir and/or steam breakthrough at the producing wells, stop or reduce steam injection and initiate injection of a noncondensable gas sufficient to scavenge heat and to maintain the distillation recovery mechanism. Draw down the producing well by producing fluids from the well or by pumping the well to minimize reservoir pressure and maximize the vapor volume. Recycle the noncondensable gas and produced water.

(d) To overcome gravity override or channeling by the noncondensable gas, a suitable foaming surfactant is injected with the gas to create a foam block in the swept zone and to divert the gas into oil producing unswept zones. Other diverting processes (polymers, emulsions, etc.) may also be used. The noncondensable gas may consist of, but not be limited to one or more of the following gases: nitrogen, air, $CO_2$, flue gas, hydrocarbon gas (i.e., methane, ethane, propane, butane, pentane, and any hydrocarbons that are gaseous at steamflood conditions).

A modification of the Process 1 described above includes the following procedures:

(a) Same as Process 1, Step (a).

(b) Once a significant distillate bank has been formed, lower the steam injection pressure, temperature and rate to lower the rate of heat loss while maintaining the steam distillation drive process.

(c) Same as Process 1, Step (c).

(d) Same as Process 1, Step (d).

Another modification of the Process 1 described above includes the following procedures:

(a) Same as Process 1, Step (a).

(b) Maintain the high steam injection pressure, temperature and rate but also inject a noncondensable gas to increase the vapor volume and further enhance the steam distillation effects.

(c) After substantial heating of the reservoir and/or steam-gas breakthrough at the producing walls, stop steam injection and continue injection of the noncondensable gas to scavenge heat and to maintain the distillation recovery mechanism.

(d) Same as Process 1, Step (d).

Another modification of the Process 1 described above includes the following procedures:

(a) Same as Process 1, Step (a).

(b) Once a significant distillate bank has been formed, lower the steam injection pressure, temperature and rate to lower the rate of heat loss but also inject a noncondensable gas to increase the vapor volume and enhance the steam distillation effects.

(c) Same as Process 1, Step (c).

(d) Same as Process 1, Step (d).

A further modification of the Process 1 described above includes the following procedures:

(a) In hot (>200° F.) light oil reservoirs inject only noncondensable gas to recover oil by a gas drive mechanism and by vaporization of the residual oil. The injected gas may be heated to reservoir temperature or greater by adding steam or by preheating at the surface.

(b) Same as Process 1, Step (d).

The steam and gas distillation drive processes described herein can recover additional oil from a subsurface earth formation above and beyond what would be recovered by conventional steamflooding alone, using the equivalent amount of injected steam. The processes described use conventional oil field equipment, including steam generators and gas compressors. Foam generators and foaming materials are described in U.S. Pat. Nos. 3,603,398, S. O. Hutchison et al, issued Sept. 7, 1971 for "Method of Placing Particulate Material In An Earth Formation With Foam" and 3,463,231, S. O. Hutchison et al issued Aug. 26, 1969 for "Generation And Use of Foamed Well Circulation Fluids".

While certain preferred embodiments of the invention have been specifically disclosed, it should be understood that the invention is not limited thereto as many variations will be readily apparent to those skilled in the art and the invention is to be given its broadest possible interpretation within the terms of the following claims.

What is claimed is:

1. A method of recovering petroleum from a subterranean, petroleum containing, permeable formation, said formation being penetrated by at least one injection well and by at least one production well, comprising the steps of:

(a) injecting steam into said formation through said injection well, said steam being injected at high temperature, high pressure and high volume to rapidly initiate and maintain steam distillation of petroleum within said formation;

(b) distilling said petroleum in the form of a distillate bank ahead of said steam within said formation;

(c) monitoring at said production well temperature and pressure conditions of reservoir materials as well as fluid production into said production well related to said injection into said injection well;

(d) initiating injection of a noncondensable gas into said formation through said injection well where said steam distillation of said petroleum has been initiated and maintained;

(e) injecting with said steam and noncondensable gas a foamable surfactant capable of producing a foam at formation temperatures and pressures to flow into said formation and reduce steam and gas breakthrough at said production well; and (f) based on the monitoring of production well conditions, maximizing said distillate bank by manipulating the temperature, pressure and volume of reservoir materials.

2. The method of claim 1 wherein said maximizing step comprises the step of, after steam breakthrough or after substantial heating of the formation at said producing well, terminating said steam injection and continuing injection of said noncondensable gas.

3. The method of claim 1 wherein said maximizing step comprises the steps of:

(a) determining from said step of monitoring said conditions in said production well that said distillation has been initiated in said formation;

(b) reducing the pressure in said formation by producing said petroleum and associated water as soon as said petroleum and water flow into said producing well to minimize reservoir pressure and maximize the vapor volume of said steam and said noncondensable gas thereby maximizing said distillation of said petroleum; and (c) then lowering said injection steam temperature, pressure and volume simultaneously with said injection of noncondensable gas.

* * * * *